US005433446A

United States Patent [19]

Lindstedt, Jr.

[11] Patent Number: 5,433,446

[45] Date of Patent: Jul. 18, 1995

[54] GOLF CLUB DIRECTIONAL INDICATOR

[75] Inventor: Charles I. Lindstedt, Jr., Stroudsburg, Pa.

[73] Assignee: Marshall's Arts, Inc., Bethesda, Md.

[21] Appl. No.: 242,329

[22] Filed: May 13, 1994

Related U.S. Application Data

[63] Continuation-in-part of Ser. No. 115,022, Sep. 2, 1993, abandoned.

[51] Int. Cl.[6] ..... A63B 69/36

[52] U.S. Cl. ..... 273/187.4; 273/187.6

[58] Field of Search ..... 273/187.4, 213, 186.1, 273/186.2, 164.1, 164.2, 187.6

[56] References Cited

U.S. PATENT DOCUMENTS 4,235,441 11/1980 Ciccarello ..... 273/187.3 X 5,228,695 7/1993 Meyer ..... 273/187.4

*Primary Examiner*—George J. Marlo

*Attorney, Agent, or Firm*—Pollock, Vande Sande & Priddy

[57] ABSTRACT

A device for insuring that directional stability is monitored and maintained in three axes when addressing a golf ball with a golf club. Visual alignment and club head positioning is obtained through the use of holograms affixed to the heads of the clubs so that a visual check by the holder of the club reveals the image or object in three dimensions when the dub is improperly positioned and in two dimensions when it is perfectly positioned. Image color(s) are also used to enhance recognition of proper club head positioning.

10 Claims, 5 Drawing Sheets

GOLF CLUB DIRECTIONAL INDICATOR

RELATED INVENTIONS

This is a continuation-in-part of U.S. Ser. No. 08/115,022, filed Sep. 2, 1993, now abandoned.

FIELD OF THE INVENTION

This invention relates generally to golf club positioning and in particular to a visual aid which indicates to the golfer when the golf club is properly positioned to strike a ball in the direction and trajectory desired.

BACKGROUND OF THE INVENTION

A long-existing problem in the game of golf is the positioning of the golf club so that, when addressing a golf ball, the strike face of the club is properly oriented to produce a straight or intended flight of the ball when struck. Among the manifestations of inadequate positioning is curving the ball to the left (hooking) or to the right (slicing) for a right-handed player. The opposite applies for a left-handed player. Another manifestation is that the ball may go straight but to the right without curving, or straight but to the left without curving, or that it may be hit higher or lower than desired. Any of these problems could be at least partially corrected with proper club positioning at address.

The art of club positioning and alignment has been very elusive, especially for "weekend golfers" or novices.

Use of playing partners for aligning purposes provides the golfer with only a general indication of alignment on one axis of rotation.

The use of sighting markers such as golf dubs set in alignment with the target provides a general directional sense for the golfer but does not provide an indicator for precise golf club positioning through three axes of rotation.

The use of contoured grips for hand-positioning does not address the indicator, or visual verification of correct club positioning and moreover, violates official golf rules.

U.S. Pat. No. 5,228,695 discloses an alignment device which addresses one axis of club head rotation, but ignores the other two axes, each of which has equal influence on the direction and trajectory of the ball when struck.

Golf ball marking, such as disclosed in U.S. Pat. No. 4,235,441 has no control on or any visual indication in the precise positioning of the golf club in any axis.

For a shot to be hit along the intended line of flight without turning left or right or higher or lower than intended, the club must be positioned so that the strike face is perpendicular to the line of intended flight and that the club head is properly positioned, i.e., avoiding the toe-up (upright), toe-down (flat) face-up or face-down attitudes, all of which contribute to the unwanted results mentioned above.

None of the above-cited references, nor any prior art device known to applicant, illustrates to the golfer the instantaneous visual indication of golf club positioning through three axes of rotation.

In accordance with the invention it will become possible for the golfer by visual observation of the object displayed in the hologram affixed to the head of the golf club to alter the position of the dub head to precisely the correct position for hitting the desired shot, and hence to deal with the problems of club positioning and alignment.

SUMMARY OF THE INVENTION

An object of the present invention is to provide a new and inexpensive device for insuring against hitting a golf ball in a direction other than that intended, with greater precision and with shot replicability.

Another object of this invention is to provide a unique, pleasing and colorful finish for golf dubs, commonly called "woods", but comprising metal or composite materials, and may include any club in a set including the putter, if of sufficient size to accommodate the hologram.

The present invention, by which the above objects are obtained, comprises juxtaposing hologram decals with a specific three-dimensional image comprised of four sides and a top surface with a reference perimeter, on the top of golf club heads in a manner that visually translates club positioning through three axes of rotation by the display of a three-dimensional object or pattern. When the dub head is positioned improperly, the holographic image or object will display misalignment showing depth, or the "vertical" components of the object and/or disjointed lines and color change on the top surface of the image. Each of the three axes will present, or be represented by, a different side(s) of the holographic image which will be in color. When the club head is positioned properly, the depth of the image disappears and only the two-dimensional aspects, in alignment within the perimeter, remain visible.

Detailed Description of the Invention

As defined by McGraw-Hill Encyclopedia of Science and Technology, holography is a technique for recording and later reconstructing the amplitude and phase distributions of a coherent wave disturbance. This is accomplished by recording the pattern of interference between the unknown object wave of interest and a known reference wave. In general, the object wave is generated by illuminating the three-dimensional subject of concern with the coherent light beam. The waves reflected from the object strike a light-sensitive recording medium such as photographic film or plate. Simultaneously a portion of the light is allowed to bypass the object, and is sent directly to the recording plane, typically by means of a mirror placed next to the object. Thus, incident on the recording medium is the sum of the light from the object and mutually coherent reference wave.

While all light-sensitive recording media respond only to light intensity, nonetheless, in the pattern of interference between reference and object waves, there is preserved a complete record of both the amplitude and the phase distribution of the object wave. Amplitude information is preserved as a modulation of the depth of the interference fringes while phase information is preserved as variations of the position of the fringes.

The photographic recording obtained is known as a hologram (meaning a total recording). When this photographic transparency is illuminated by coherent light, one of the transmitted wave components is an exact duplication of the original object wave. This wave component therefore appears to originate from the object and accordingly generates a virtual image of it, which appears to an observer to exist in three-dimensional space. The image is truly three-dimensional in the sense that the observer's eyes must refocus to examine foreground and background and indeed can "look behind" objects in the foreground simply by moving the hologram or the head laterally.

Figure 1:
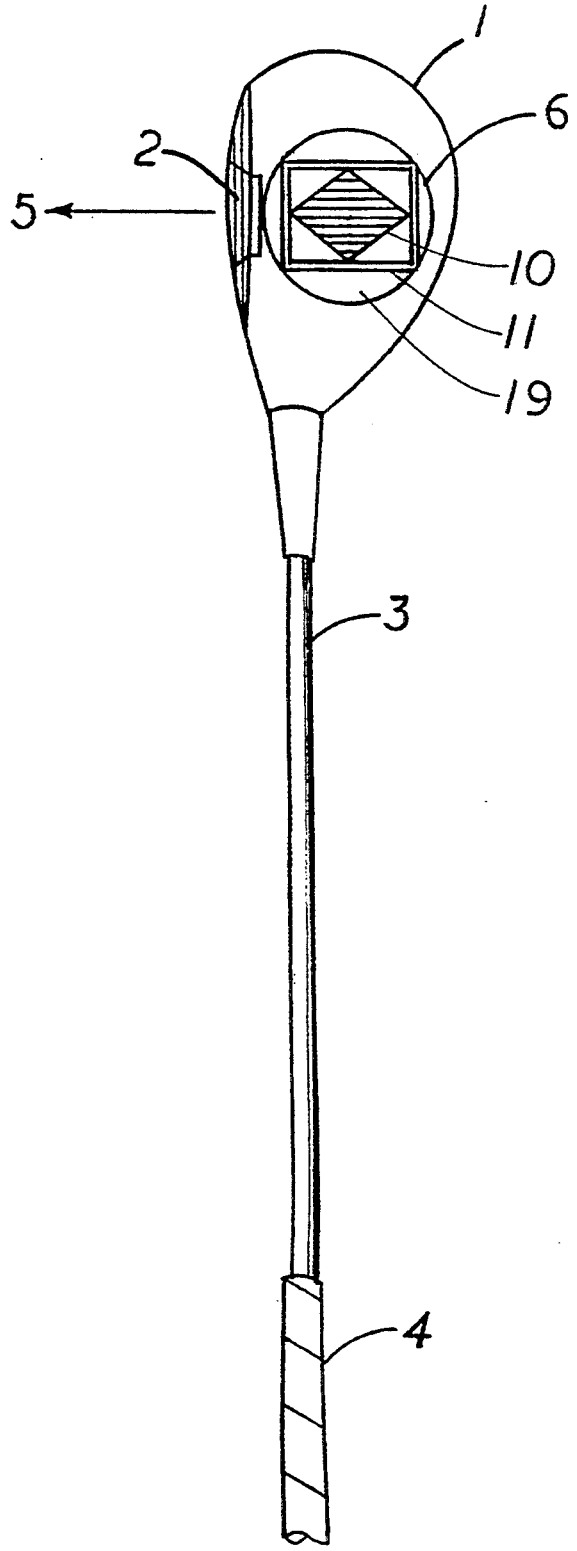
FIG. 1 is a view of a golf dub properly positioned from the holder's point of view, whose design embodies the method and device according to the invention.

As depicted in FIG. 1, the invention provides for the use on golf clubs of three-dimensional image holograms 6 with vertical and horizontal parallax and planar rotation imaging, for top surface change in color and form, to assist the holder of the club to properly position and align himself and the club head 1 with the ball and target 5, thereby greatly enhancing the probability of obtaining the accuracy necessary to keep the ball, when struck, on the line of intended flight and along the desired trajectory.

Figure 2:
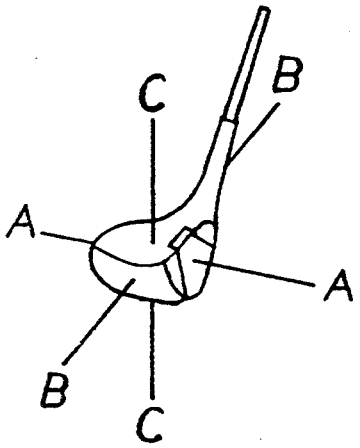
FIG. 2 is a schematic view of the three axes of rotation that are possible in the positioning of a golf dub when preparing to hit a golf ball.
Figure 3:
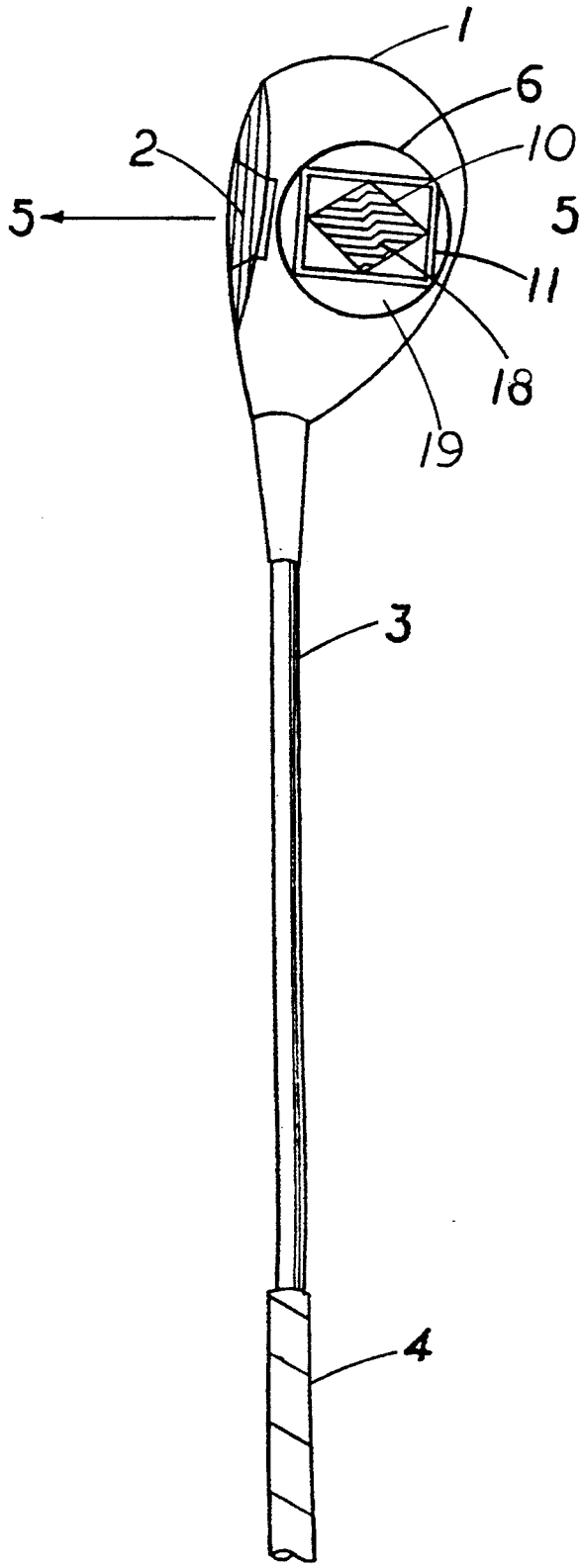
FIG. 3 is a view of the golf dub, from the holder's point of view, when the club is held in open position, the three-dimensional image exhibiting the changed top surface.
Figure 4:
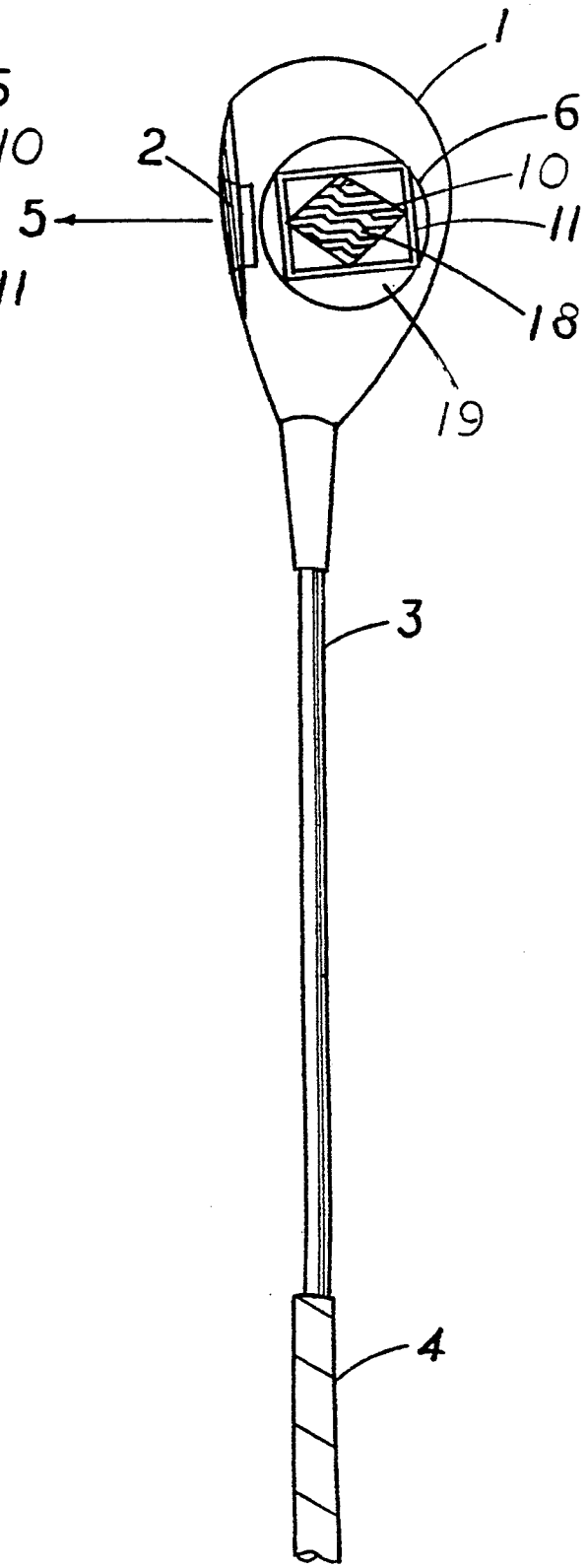
FIG. 4 is a view of the golf club, from the holder's point of view, when the club is held in closed position, the three-dimensional image exhibiting the changed top surface.
Figure 5:
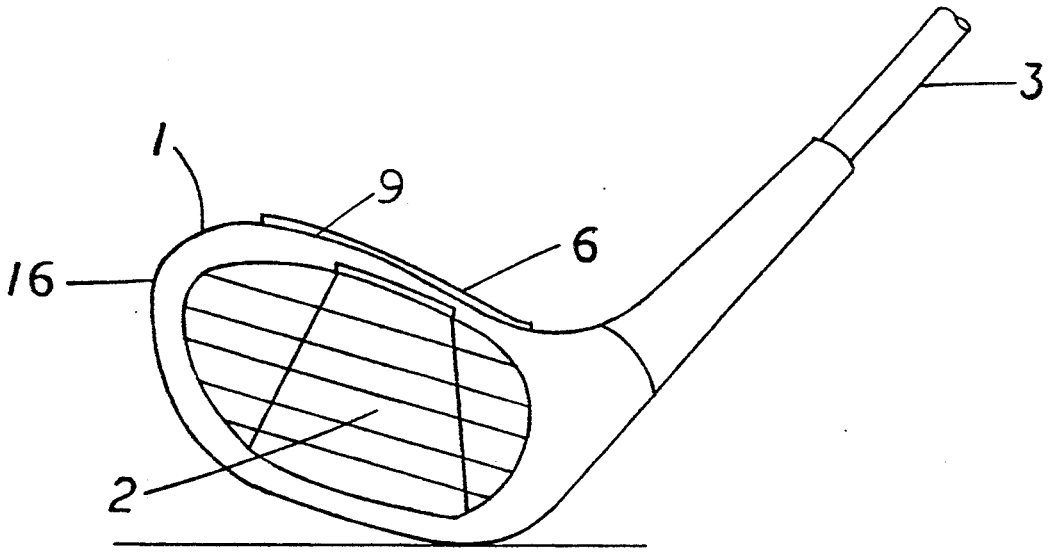
FIG. 5 is a view of the golf dub from the intended line of flight, or target, shown in an upright lie position.

Holograms 6 are comprised of a three-dimensional image of an object within a decal having a thickness of about 0.0005 to 0.002 inch, made of photopolymer plastic with an adhesive backing able to withstand temperatures of 0.0° to 140° F., and being waterproof without requiring a further protective coating, without peeling, cracking or undue fading for extended periods of time and exposure such as experienced during a golf season. Alternatively, materials such as polyester or hot stamping foil may be used. Since the hologram 6 is a photograph, it is not dependent on lens projection or other than available light sources. The image or object design will be, but is not limited to, the shape of a diamond or parallelogram 10 when viewed in two dimensions (plan view), but it will be a rhombohedron having a depth, e.g., of three-quarters of an inch when viewed in three dimensions, the four sides and top surface of which will be in contrasting colors, set inside a two dimensional reference perimeter 11 located on the bottom plane of the hologram 6, which will be a colorful field. This design will allow precise club head position monitoring by showing the diamond image 10 within the reference perimeter 11 in two dimensions when held with proper loft 8, lie 7 and alignment. The top surface of the diamond image 10 will indicate proper alignment by displaying straight lines and color. When rotated on axis C—C (FIG. 2), there will be a color change and the lines 18 will become disjointed, as shown in FIGS. 3 and 4.

Instead of a diamond or parallelogram, the holograms may be in the form of bulls' eyes, arrows, straight lines or curved lines, or any other form and coloring which would serve the purpose of the invention.

One manufacturer of holograms that has the capabilities to produce such a hologram is U.S. Holographics, P.O. Box E, Logan, Utah 84323.

Golf clubs for which the invention is intended are generally of a standard design, all with a ball striking surface 2 and a shaft 3, at the opposite end of which is affixed a grip 4. The club head 1 which comprises the strike face 2 is made of metal, wood or composite material. The shaft 3 is constructed of steel, wood or a composite material. The clubs in a set employ shafts of different lengths, different dub head lofts 8, and due to the shaft length difference, lies. As the club head 1 is placed behind the ball, the holder aligns the strike face 2 by rotating the club on axis C—C 90° to the intended line of flight 5 of the ball, on axis A—A for positioning of a proper lie, and on axis B—B for proper loft. When that is achieved, the holder endeavors to strike the ball with the club head in that position. A miscalculation of five degrees left or right of the intended line 5 can result in an error of seventeen and one-half yards left or right at two hundred yards distance. That calculation does not take into account the added curving of the ball when hit with an open or dosed strike face 2. This could bring the total result to forty yards off-line. When the club head 1 is rotated clockwise about axis C—C in an open position, the effective loft 8 is increased, propelling the ball into a higher trajectory and increasing the spin rate, thus, causing the ball to curve to the right at an increased rate with a resultant loss of distance and direction. The opposite occurs when the dub is rotated in a counter-clockwise direction about axis C—C, creating a closed face. Here, the ball will be propelled in a lower trajectory and curve to the left and, due to the dosed attitude, the dub will impart an overspin to the left with a great deal of run after it hits the ground. To this must be added the compounded ball flight error when the dub 1 does not address the ball with the proper lie. If the lie of the club is off by any significant amount, the holder will experience directional control problems. The upright lie will tilt the strike face 2 to the left, about axis A—A, of the intended line of flight 5, causing the ball to be driven off-line to the left. The flat lie will cause the face of the club 2 to tilt to the right, about axis A—A, of the intended line of flight 5, causing the ball to be driven off line to the right. These lies are caused by standing too far from the ball or holding the hands too low for an upright lie and standing too close to the ball or holding the hands to high for the flat lie.

These facts make it mandatory that the holder of the golf dub be properly positioned in relation to the ball and that the golf club be held in such a position that, for a ball to be hit to a target 5, it has the correct lie and that the ball strike face 2 be aligned at 90° to the line of intended flight 5 with the face 2 not tilted up or down. The exception to this statement, to be discussed hereinbelow, is when the holder intentionally curves the ball left or right and/or into a high or low trajectory.

When the hologram 6, according to the invention, is applied in precisely the correct position on the dub head 1, the following results become apparent. Turning the shaft 3 slightly (0 to 5 degrees) to the right or left about axis C—C (FIGS. 3 and 4) opens or doses the strike face 2 sufficiently to change the appearance of the hologram 6 affixed to the club head 1. This change is manifested in the form of disjointed lines 18 and a color change on the top surface 10 of the three-dimensional holographic object in hologram 6.

Figure 6:
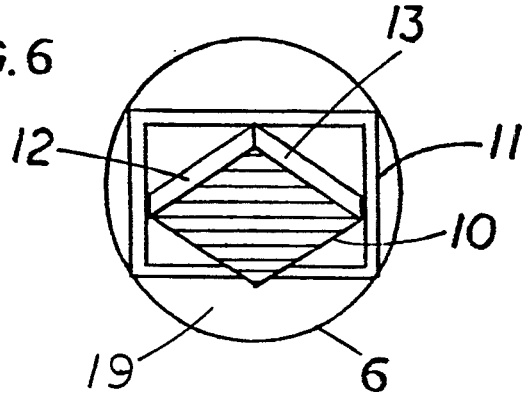
FIG. 6 is a holder's view of the hologram when the golf club is held in an upright lie position.
Figure 7:
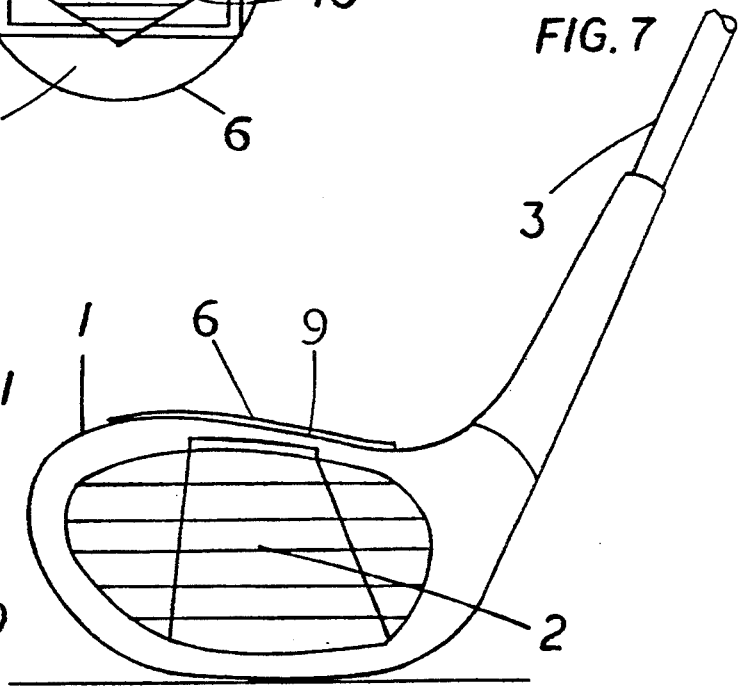
FIG. 7 is a view of the golf club head from the intended line of flight, or target, in the, proper lie position, rotated 90° from the position shown in FIG. 1.
Figure 8:
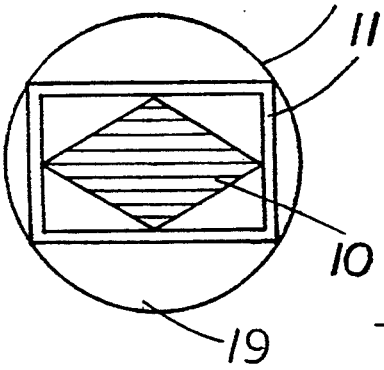
FIG. 8 is a view of the hologram similar to that shown in FIG. 1 when the club is held in the proper position.

If the toe 16 of the golf club is raised into an upright lie about axis A—A, the three-dimensional object in hologram 6 displays surfaces 12 and 13 and the reference perimeter 11 is broken on the near side (FIG. 6).

Figure 9:
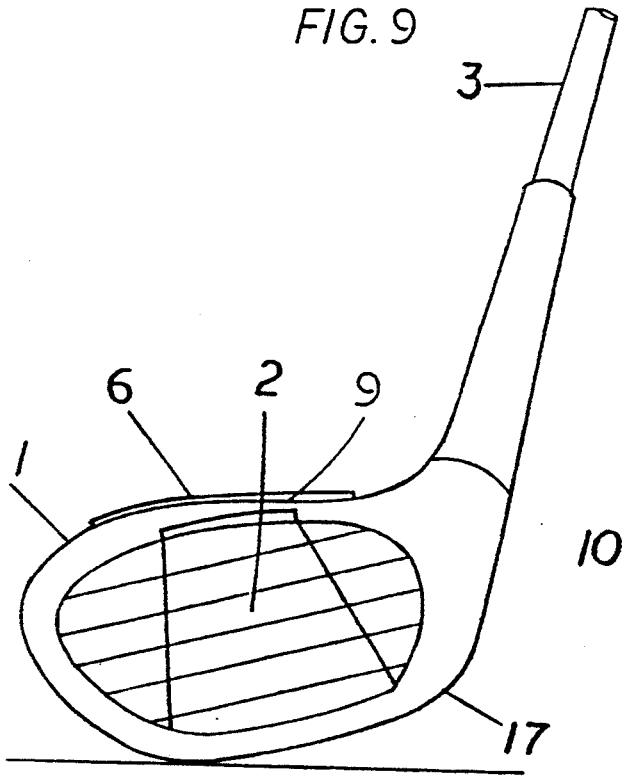
FIG. 9 is a view of the golf club head from the intended line of flight, or target, in a flat lie position.
Figure 10:
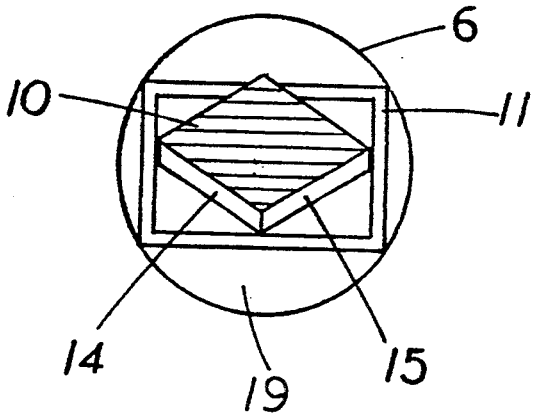
FIG. 10 is a holder's view of the hologram when the golf club is held in a flat lie position.

If the heel 17 of the golf club is raised about axis A—A (FIG. 9), the hologram 6 displays surfaces 14 and 15 on the object and the reference perimeter 11 is broken on the far side (FIG. 10).

Figure 11:
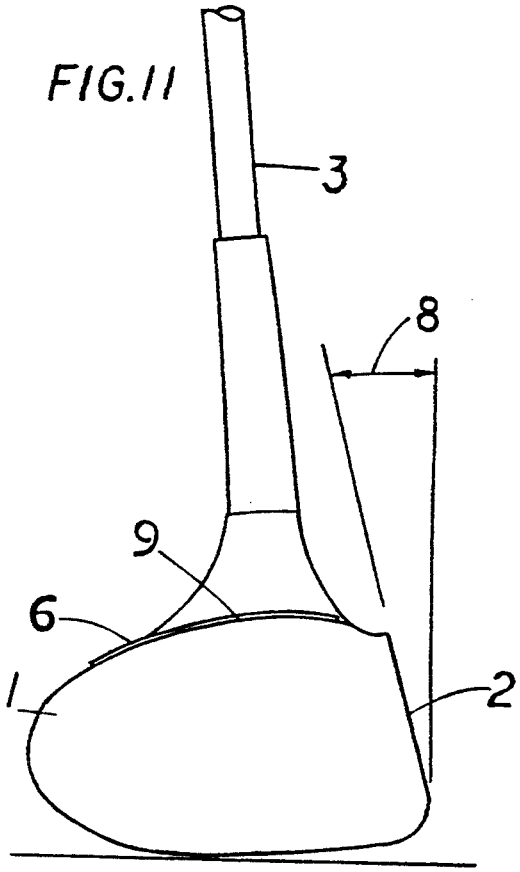
FIG. 11 is a view of the golf club at ground level 90° from the target line with the club face rotated up.
Figure 12:
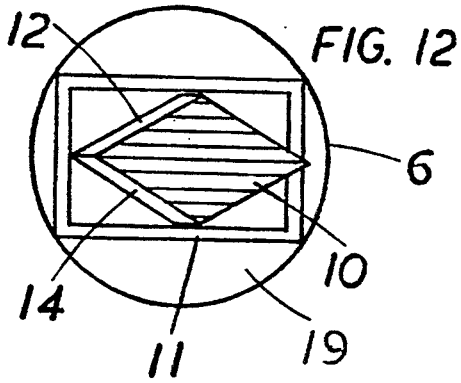
FIG. 12 is a holder's view of the hologram when the club face is rotated up.
Figure 13:
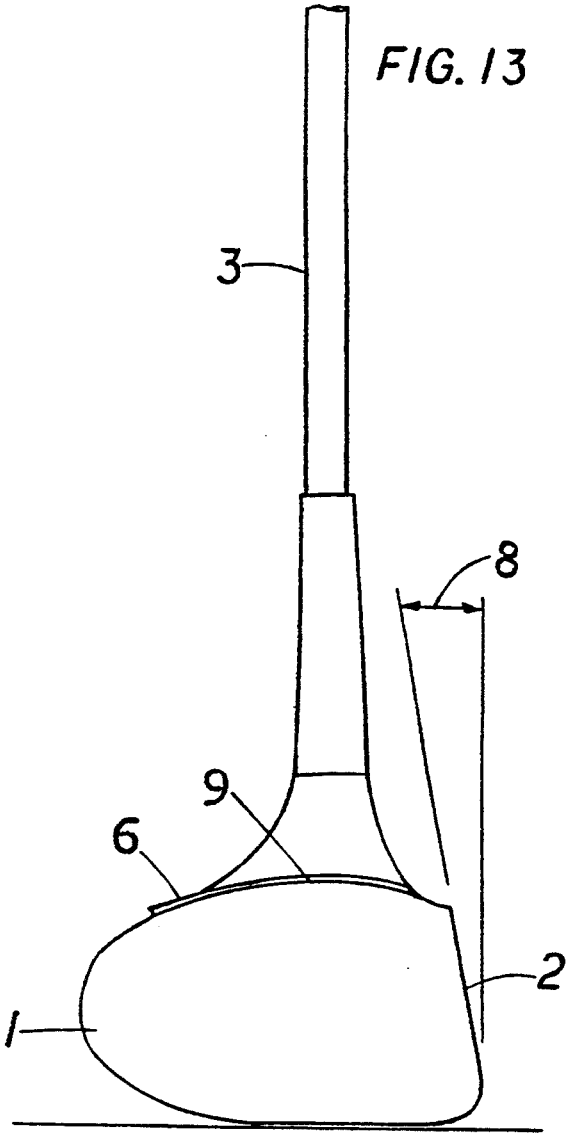
FIG. 13 is a view of the golf club at ground level 90° from the target line with the proper lie showing a typical loft.

If the club head 1 is rotated about axis B—B with the strike face 2 tilted up (FIG. 11), hologram 6 displays surfaces 12 and 14 on the object and the reference perimeter 11 is broken on the right side (FIG. 12).

Figure 14:
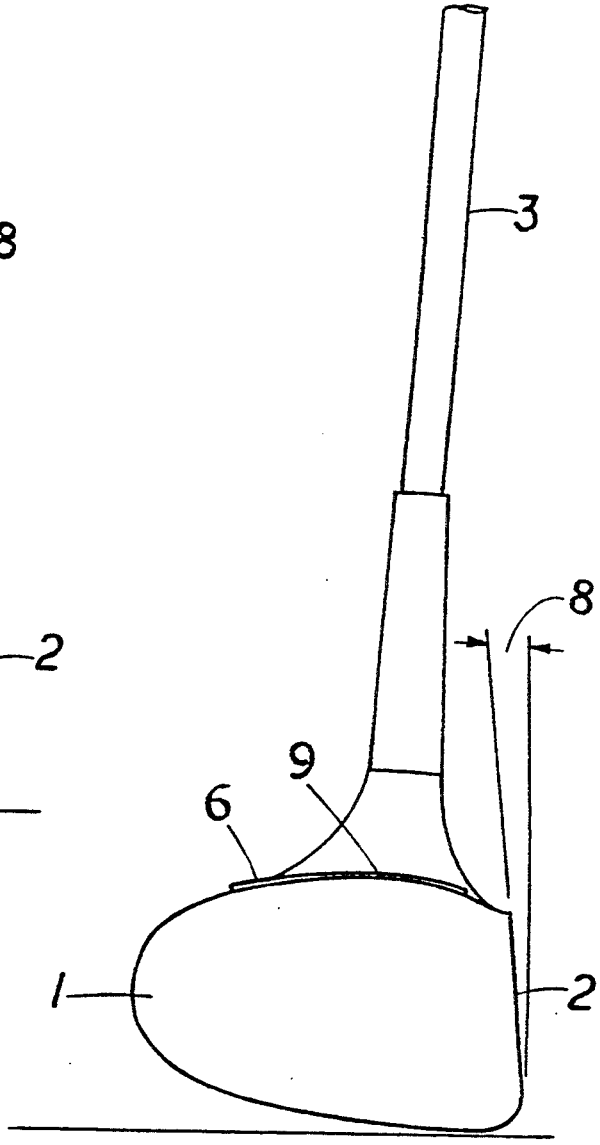
FIG. 14 is a view of the golf club at ground level 90° from the target line with the club face rotated to the down position.
Figure 15:
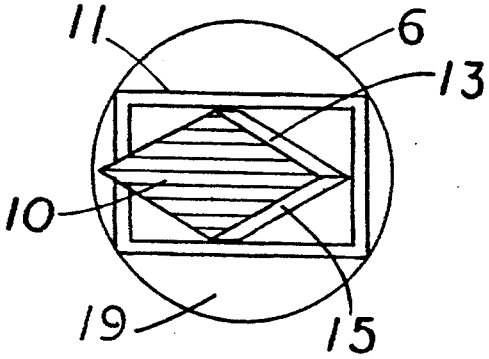
FIG. 15 is a holder's view of the hologram when the strike face is rotated down.

If the club head 1 is rotated about axis B—B with the strike face 2 tilted down (FIG. 14), surfaces 13 and 15 on the object in the hologram 6 are displayed and the reference perimeter 11 is broken on the left side (FIG. 15).

It is apparent that simultaneous mispositioning of the golf club in more than one axis would result in compounding the resultant view of the holographic image showing multiple depths of multiple sides of the object in hologram 6, depending upon the degree of mispositioning.

At times, when playing golf, it is advantageous to intentionally curve the ball left or right. By observing the three-dimensional holographic image alignment attitudes in hologram 6, the club holder will be able to ascertain proper club head 1 rotation about axis C—C or A—A to effect curving the ball intentionally left or right.

To effect a high or low shot, the club head 1 is rotated about axis B—B. Counterclockwise rotation results in a low shot, while clockwise rotation results in a high shot. It is then possible to replicate golf club positioning by replicating the position of the object in hologram 6 in all three axes so that the user will start his swing from the desired position, thereby greatly enhancing the probability of hitting the ball in the desired trajectory on the target line.

The present invention may be readily grasped through reference to the embodiment illustrated in FIG. 1. By observing the hologram 6 pattern on the club head 1, the golfer can ascertain whether the face 2 is properly aligned and club 1 soled with a proper lie. The three-dimensional image in the hologram will appear in only two dimensions, length and width, and the diamond 10 within the reference perimeter 11. The depth and the disjointed lines 18 will appear only when the club is mispositioned.

Golf club design and finishing have long depended on aesthetics for confidence-building in the user. A pleasing shape and finish enhance the probability of successful use. The use of holograms 6 on the crown surface 9 would afford the possibility of unique appearance treatments for golf dubs. The holograms 6 affixed to the dub head 1 could, for example, be transferred to that surface when a decal slips off a wetted backing and adheres to the club head 1 surface when dry, as golf club manufacturers presently apply their company logo decals, or have its own adhesive backing for golf clubs already in use or on sale. Final transparent protective coating(s) could then be applied for a permanent final finish, as is presently done by manufacturers. Golf club manufacturers and repair facilities would doubtless have their own methods for applying the holograms, possibly including direct transfer from die-to-club, eliminating the decal.

Jigs and fixtures (club holding and aligning devices) would have to be employed to precisely position the holograms 6 on the club head 1 to assure proper alignment with the club face 2. These tools are currently available to golf dub manufacturers and repair facilities including golf club professional shops. Additionally, templates may easily be designed to assist in properly affixing the hologram decal on the club head.

The invention obviates the use of active devices such as levels, lenses or protruding mechanical sighting appendages, most of which are deemed illegal by official golf agencies, to attain a precise method of golf club positioning. This invention therefore lends itself to the manufacture of new golf clubs and to the retrofitting of clubs already in use or on sale.

It will be obvious that the invention can be applied to other types of sports equipment wherein directional indications are desirable, e.g., bowling balls, tennis rackets and croquet mallets.

What is claimed is:

1. A device comprising a three-dimensional hologram affixed to a golf club to enable precise golf club positioning relative to three axes of rotation when preparing to hit a golf ball to a specific target on a preselected trajectory, wherein said hologram combines vertical, horizontal and planar rotation imaging which enables club head positioning through visual observation of a three-dimensional rhombohedron image, said hologram being affixed to an upper surface of a head of said golf club in a manner such that said three-dimensional image appears within a reference perimeter on a background field in a configuration that indicates proper golf club head positioning for a shot having a particular desired target and trajectory, and wherein indications of golf club positioning are combined in a single hologram directly visible to a golfer when addressing a golf ball.

2. The device according to claim 1, wherein violation of said reference perimeter indicates mispositioning of said golf club relative to two specified axes of rotation.

3. The device according to claim 1, wherein colored sides on said rhombohedron indicate golf club mispositioning through two specified axes of rotation.

4. The device according to claim 1, wherein planar rotation imaging on a top surface of said rhombohedron shows disjointed lines when said golf club is mispositioned relative to one specified axis of rotation.

5. The device according to claim 1, wherein the hologram is made of photopolymer plastic.

6. The device according to claim 1, wherein the hologram is made of polyester.

7. The device according to claim 1, wherein the hologram is made of hot stamping foil.

8. The device according to claim 1, wherein the hologram has a self-adhesive backing.

9. The device according to claim 1, wherein the hologram has a water-activated adhesive backing.

10. The device according to claim 1, wherein said golf club is a wood-type golf club comprising a club head, and said affixed hologram has as a background a field upon which the reference perimeter and the rhombohedron in contrasting colors are placed providing coloring for said wood-type golf club head.

* * * * *

UNITED STATES PATENT AND TRADEMARK OFFICE

CERTIFICATE OF CORRECTION

PATENT NO. : 5,433,446
DATED : July 18, 1995
INVENTOR(S) : Charles I. Lindstedt, Jr.

It is certified that error appears in the above-indentified patent and that said Letters Patent is hereby corrected as shown below:

On the title page item [57] abstract, line 7 of the text, change "dub" to --club--.

In column 1, line 35, change "dubs" to --clubs--;
on line 67, change "dub" to --club--.

In column 2, line 10, change "dubs" to --clubs--;
on lines 22, 34, 38, 40, and 48, change "dub" to --club--.

In column 4, lines 32, 51, 55 and 56, change "dub" to --club--;
on lines 44 and 54, change "dosed" to --closed--.

Signed and Sealed this

Third Day of October, 1995

*Attest:*

*Attesting Officer*

Bruce Lehman

BRUCE LEHMAN

*Commissioner of Patents and Trademarks*